US005682841A

United States Patent [19]

Schimmeyer et al.

[11] Patent Number: 5,682,841

[45] Date of Patent: Nov. 4, 1997

[54] VARIABLE FLOW VOLUME CONTROL BAFFLE AND VENT DAMPER

[76] Inventors: Werner K. Schimmeyer, 8937 Acorn Pl., Santa Rosa, Calif. 95409; Larry K. Acker, 223 Oceanview, Newport Beach, Calif. 92663

[21] Appl. No.: 585,497

[22] Filed: Jan. 16, 1996

[51] Int. Cl.[6] ..... F22B 5/04

[52] U.S. Cl. ..... 122/17; 122/13.1

[58] Field of Search ..... 110/162, 163; 122/13.1, 14, 15, 16, 17, 44.1, 44.2, 155.1, 155.2

[56] References Cited

U.S. PATENT DOCUMENTS

| | | | |
|---|---|---|---|
| 4,344,479 | 8/1982 | Bailey | 122/44.2 |
| 4,549,525 | 10/1985 | Narang | 126/361 |
| 4,770,160 | 9/1988 | Schimmeyer | 126/285 |
| 4,953,510 | 9/1990 | Akkala et al. | 122/17 |
| 5,239,947 | 8/1993 | Schimmeyer | 122/17 |

*Primary Examiner*—Henry A. Bennett
*Assistant Examiner*—Gregory A. Wilson
*Attorney, Agent, or Firm*—Walter A. Hackler

[57] ABSTRACT

Apparatus for improving the efficiency of a water heater having a tank, a burner and a flue, the flue being disposed within the tank for evacuation of burned combustion gases therethrough with resulting heating of water in the tank, generally including combustion gas deflector for enhancing heat transfer from the combustion gases through a flue wall and into surrounding water during ignition of the burner, a vent damper for preventing ambient air in the flue, heated by the directing means and flue, from escaping the flue during nonignition of the burner.

11 Claims, 2 Drawing Sheets

VARIABLE FLOW VOLUME CONTROL BAFFLE AND VENT DAMPER

The present invention generally relates to apparatus for gas and/or oil water heaters and is more particularly adapted to apparatus for improving the efficiency of a gas and/or oil water heater, hereinafter generally referred to as a gas water heater.

Typical fuel-burning water heaters include a combustion chamber disposed in a base of a water tank with a flue disposed within the tank for evacuation of the burner combustion gases therethrough and concomitant heating of water in the tank. The combustion gases exiting the water heater flue are typically passed through an exhaust flue for proper venting.

Heretofore, many water tank flues comprised an open tube or duct for conduction of the combustion gases. A major design impediment to providing apparatus for heat transfer enhancement is the fact that while heat transfer may be improved from the combustion gas during ignition of the gas burner, reverse heat transfer from the water to the flue is also enhanced, thus negating any efficiency enhancement of such a device.

That is, after the burning of the fuel in the combustion chamber, heat from the hot water in the tank is passed into the water tank flue and thereafter into the exhaust flue.

Even without such heat transfer enhancement devices, the energy losses through the water tank flue can be significant due to heat transfer from the water during non-ignition periods of the burner.

A number of damping devices, for example, those set forth in U.S. Pat. Nos. 4,770,160 and 5,229,947 to Schimmeyer, decrease energy loss from a water heater by restricting the flow of air through the water heater flue when the burner is not ignited, thus conserving heat within the tank. However, while this apparatus is effective in increasing efficiency of a water heater by way of preventing the escape of hot combustion gases during nonignition of the burner and the circulation of cool air within the water heater flue, it does not enhance the heat transfer of the combustion gases into the water tank.

The present invention provides apparatus for the enhancement of heat transfer from the combustion gases to water in a hot water heater through a flue, while at the same time preventing the improved heat transfer between the flue and the tank from decreasing the overall efficiency of the hot water heater during nonignition periods.

SUMMARY OF THE INVENTION

Apparatus in accordance with the present invention for improving the efficiency of the gas water heater having a tank, gas burner, and a flue, with the flue being disposed within the tank, generally includes combustion gas directing means for enhancement of heat transfer from the combustion gases through the flue and the surrounding water during ignition of the burner. Thus, a baffle is provided to control the flow of combustion gases within the flue. Because of enhanced heat transfer, more of the heat carried by the heat combustion gases is transferred into water during an ignition cycle of the burner.

Importantly, in combination with the directing means, damper means are provided for preventing ambient air in the flue, heated by the directing means in the flue, from escaping the flue during nonignition periods of the burner. Thus, the enhanced heat transfer provided by the combustion gas directing means through the flue is in effect prevented from causing the enhanced heat transfer to cool the heated water via the flue by the venting means.

As hereinafter discussed in greater detail, the damper means may be any suitable type of vent damper such as disclosed in U.S. Pat. Nos. 4,770,160 and 5,239,947, hereinabove noted and incorporated herein by specific reference thereto, for showing the operation and construction of a suitable vent damper used in the combination of the present invention.

In one embodiment of the present invention, the combustion gas directing means may comprise elongate member having convolutions along a length thereof and a diameter enabling insertion into the flue. In this embodiment, the elongate member may be approximately equal to a length of the flue and include fins, protruding from the elongate member, which provide means for centering of the elongate member within the flue and further provide contact between the elongate member and the flue.

In this embodiment, the convolutions function in a manner directing combustion gases, passing through the flue, against inside flue walls which prevent channeling of hot combustion gases through a center portion of the flue without direct contact with the inside flue surfaces as occurs in flues having unobstructed flues. In addition, the fins provide for heat conduction from the elongate member into the hot water tank via the flue so that as the combustion gases heat the elongate member, such absorbed heat is transferred into the hot water via the contacted flue.

In another embodiment of the present invention in accordance with the present invention, the elongate member may include a plurality of nestable segments. This embodiment is particularly suited for the retrofit of existing water heaters where space above the installed water heater is limited, that is, without sufficient space for the installation of a unitary elongate member into the water tank flue.

More particularly, each of the plurality of segments may be cylindrical with each having a different diameter to enable the assembly of the elongate member with a diameter smaller at a bottom of the elongate member than at the top of the elongate member and provide a variable flow control baffle for the combustion gases.

This provides for establishing an annulus around the elongate member and the flue for the passage of combustion gas which widens into the direction of the combustion gas flow up the flue and to an external exhaust flue.

While one of the specific embodiments hereinabove cited is specifically suitable for the retrofit of the existing water heaters, it should be appreciated that the present invention also includes a water heater having a tank and a burner with a flue means, disposed in the tank, for evacuation of burner combustion gases therethrough with the resulting heating of the water tank. In combination therewith, combustion gas direct means are provided for enhancing the heat transfer from the combustion gas through the flue and into the surrounding water during ignition of the burner. Further, vent damper means are provided for preventing ambient air in the flue, heated by the directing means in the flue, from escaping the flue during nonignition of the burner.

BRIEF DESCRIPTION OF THE DRAWINGS

The advantages and features of the present invention will be better understood by the following description when considered in conjunction with the accompanying drawings in which.

DETAILED DESCRIPTION

Figure 1:
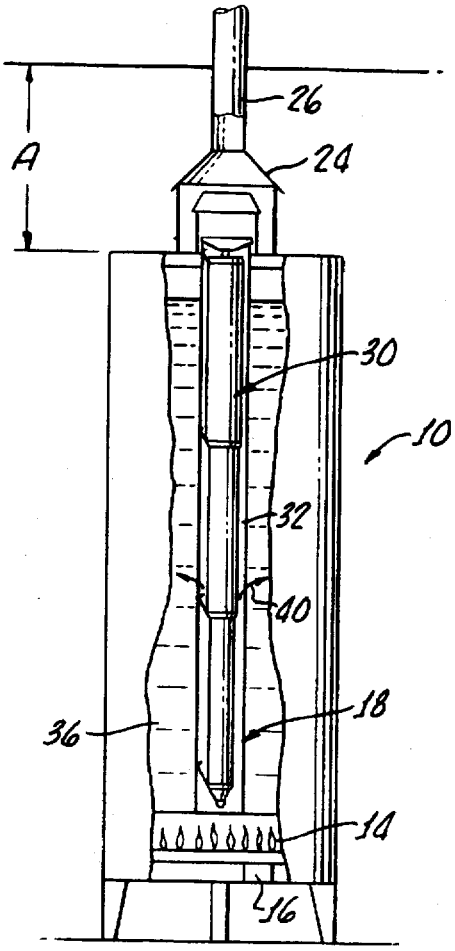
FIG. 1 is a plan view, partially broken away, of one embodiment of the present invention, generally showing a water tank with a flue therethrough heated by a burner in combination with a flue device for enhancing heat transfer and a vent damper for preventing ambient air in the flue from escaping from the flue.
Figure 3:
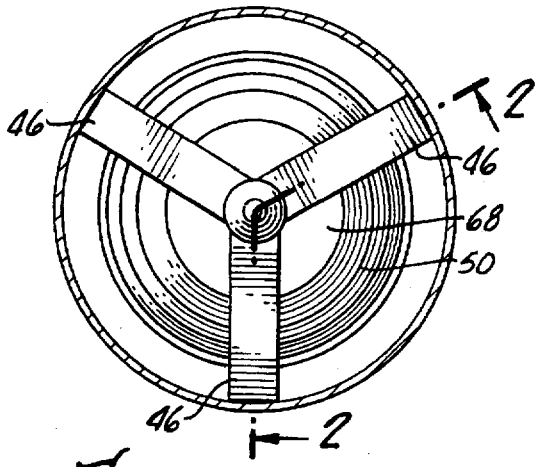
FIG. 3 is a cross-sectional view taken alone the line 3—3 in FIG. 2.
Figure 2:
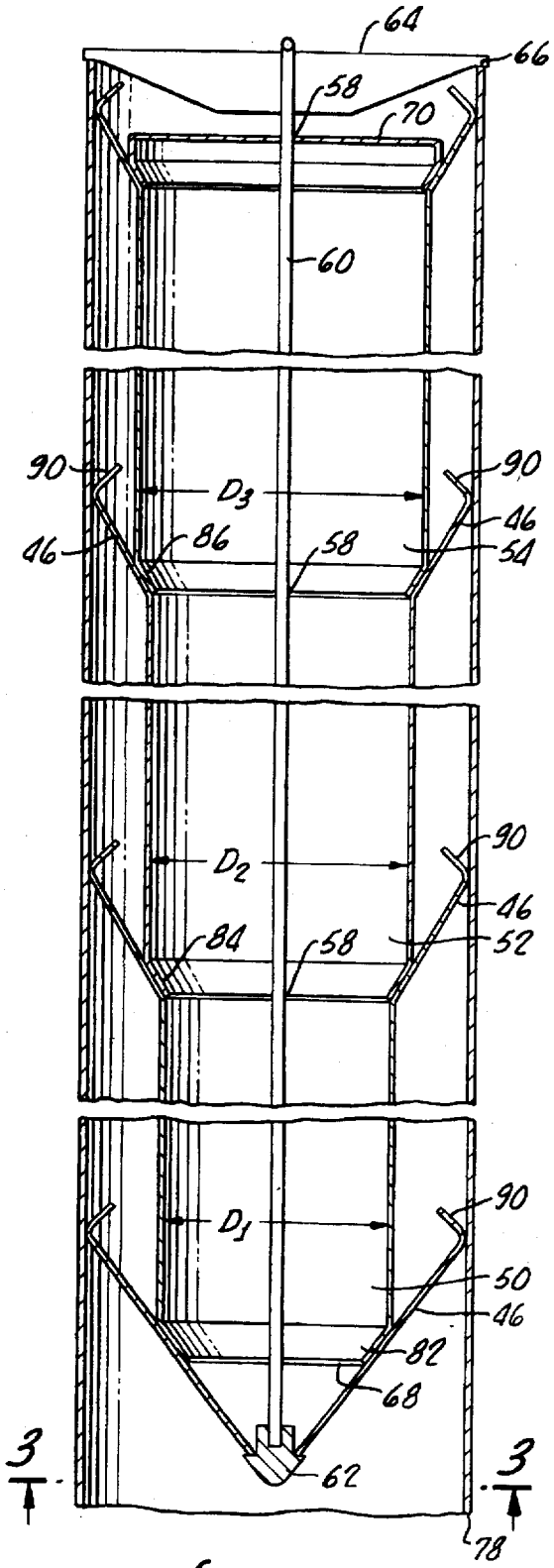
FIG. 2 is a cross-sectional view of one embodiment of the combustion gas directing means, in accordance with the present invention, particularly suitable for retrofit of existing water heaters.

Turning now to FIG. 1–3, there is shown a water heater apparatus 10, in accordance with the present invention, which generally includes a tank 12, a burner 14, disposed at the bottom portion 16 of the tank, along with a flue 18 which provides a means for evacuation of burner gases therethrough to a vent damper 24 and thereafter to an exhaust flue 26.

It should be appreciated that the tank 12, burner 14, and flue 18 of the apparatus 10 may be of any conventional suitable design. In addition, the vent damper 24 may be made in accordance with U.S. Pat. No. 4,770,160 or 5,239,947 which are incorporated herewith for providing a description of how to make and use the vent damper 24. An important component of the present invention is the heat deflector 30 which provides means for enhancing heat transfer from the combustion gases through a flue wall and into surrounding water 36, as indicated by the arrows 40 in FIG. 1.

Figure 4:
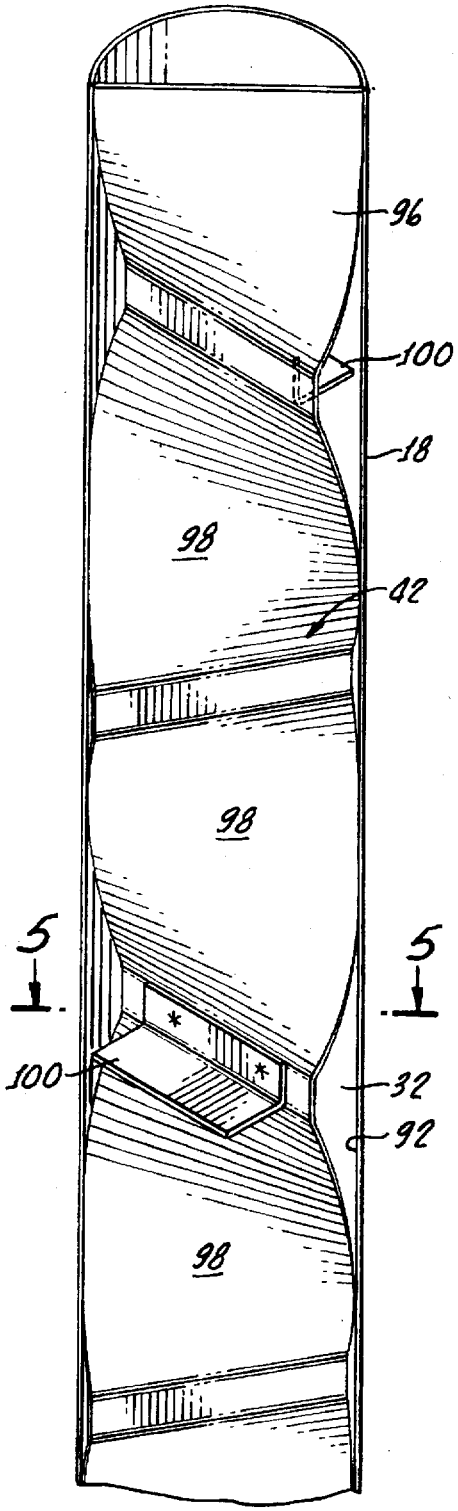
FIG. 4 is a view of another embodiment of the combustion gas directing means, in accordance with the present invention, as it may be installed in a flue.

An alternative embodiment 42 of combustion gas directing means for enhancing heat transfer from the combustion gases through the flue 18 is shown in FIG. 4.

Both of these embodiments 30, 42 effect an enhancement of heat transfer two ways. First, the deflectors 30, 42 direct rising combustion gases from the burner 14 against the flue wall 32. Additionally, conductive heat transfer from the heat deflector 30, 42 is provided to the flue wall as hereinafter discussed in greater detail.

Turning again to FIG. 2, the deflector 30 may be comprised of a plurality of cylindrical sections, or segments, 50, 52, 54, each having a length, for example, of between 12 and 14 inches in order to enable the installation of the segments 50, 52, 54 into the flue 18 when the damper 24 is removed from the tank 12 and a clearance of both an installed tank A, as shown in FIG. 1, precludes the installation of a unitary deflector (not shown).

Segments 50, 52, 54 may be formed from any suitable material, such as sheet metal, and are generally cylindrical in shape. Holes 58 formed in each of the sections 50, 52, 54 enable a wire 60 to pass therethrough which may be coupled to an end-piece 62 for enabling removal of the section from the flue 18. If necessary, the wire may be fastened to a bar 64 supported at the top of the flue 18.

Preferably, the sections 50, 52, 54 are generally cylindrical and are either closed or sealed or are fitted with an end cap 68, 70 to prevent passage of combustion gases therethrough. This, in effect, causes the combustion gases to pass through an annulus 74 established between the sections 50, 52, 54 and flue 18.

In order to further enhance contact of the combustion gases with the flue 18, each of the plurality of segments 50, 52, 54 has different diameters indicated at $D_1$, $D_2$, $D_3$ in FIG. 2. It should be appreciated that while three segments are shown, it is contemplated that a greater or smaller number of segments may be provided within the concept of the present invention.

The segments 50, 52, 54 are assembled as shown in FIG. 2 so that the increased diameters $D_1$, $D_2$, $D_3$ provide for narrowing of the annulus 74 from a bottom 78 of the flue to the top 66 of the flue 18.

In order to facilitate nesting of the segments 50, 52, 54 on one another, conical ends 82, 84, 86 may be formed into the segments 50, 52, 54.

Importantly, the fins 46, shown in FIGS. 2 and 3, which may be formed from spring steel or the like, are attached to the segments 50, 52, 54 by welding or the like and extend, or protrude, outwardly therefrom in order to center the segments 50, 52, 54 within the flue 18 by contact of angled portions 90 with a flue inside surface. Thus, metal contact is established between the inside surface 92 of the flue 18 and each of the segments 50, 52, 54. This enables heat transferred to the segments 50, 52, 54 from combustion gases to be conducted directly into the flue wall 32 and thereafter into the surrounding water 36.

Figure 6:
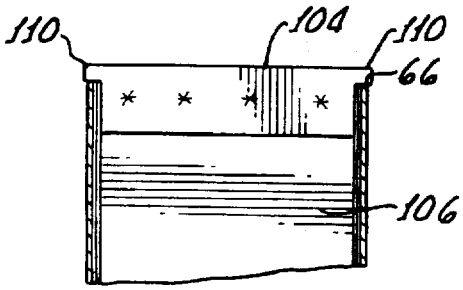
FIG. 6 is a top view of the embodiment shown in FIG. 4, showing an interconnection between the combustion gas deflecting means and the top flue.
Figure 5:
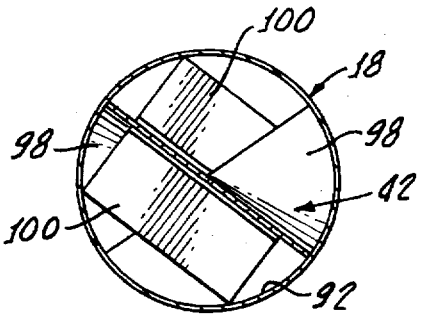
FIG. 5 is a cross-sectional view taken along a line 5—5 of FIG. 4.

An alternative embodiment 42 of a reflector is shown in FIGS. 4–6. This embodiment 42 comprises an elongate member 96 having convolutions along a length thereof for causing swirling of gases within the flue to enhance contact and heat transfer from the combustion gases through flue wall 18. Importantly, this embodiment 42 of the present invention may be formed from flexible metal in order to enable bending thereof to enable insertion into the flue 18 under conditions of limited head space of both the water heater 10, as indicated by A, as shown in FIG. 1.

In addition, fins 100 may be welded and spaced apart distances along the elongate member 96 and protrude therefrom which enables centering of the elongate member 96 within the flue 18 and providing contact therebetween to enhance conduction of the heat.

As shown in FIG. 6, an end bar 104 may be welded to a top of the member 106 to enable positioning of the member 96 within the flue 18 and prevent buckling of the member within the flue 18 by hanging the member 96 from the top 66 of flue by extended portions 110 of the end bar 104.

While there has been emphasized that heat transfer is enhanced from the combustion gases through the flue wall 32 into the water 36 during ignition of the burner 14, this improved conduction is also enabled from the water 36 when hot through the flue wall 32 and into the heat deflector 30 and thereafter up the flue 18 and through the exhaust flue 26 if it were not for action of the vent damper which prevents ambient air in the flue heated by the deflector 30 in the flue 18 from escaping the flue 18 during nonignition of the burner. Hence, the enhanced heat transfer imparted by the deflector 30 in accordance with the present invention is prevented from reducing the water heater efficiency 10 by the escape of warmed air into the exhaust 26.

Calculations have been made showing the benefit of using combination of the present invention, which includes the heat deflector 30 and the vent damper combination installed on a 30-gallon, 40-gallon, and a 50-gallon domestic gas water heated tank, as shown in Tables 1 through 3. Table 4 gives the parameters for the analysis set forth in Tables 1, 2 and 3.

As shown in the tables, significant heat and energy savings are expected with accompanying savings to the user of a water tank made in accordance with the present invention or modified utilizing the apparatus in accordance with the present invention.

TABLE 1

Benefits of Vent Damper and Heat Deflector: 30-Gallon Tank

| | Base Case | Vent Damper | Vent Damper & Heat Deflector 75% | 80% | 85% |
|---|---|---|---|---|---|
| Energy Needed to Heat Water for Consumption | | | | | |
| Energy to Heat Daily Water Consumption | | | | | |
| Consumption Energy (BTU per day) = Gallons Consumed*8.33 lb/gal*1*(tank Water Temp – Supply Water Temp) | 47981 | 47981 | 47981 | 47981 | 47981 |
| Input Energy Needed for Daily Consumption Input Energy (BTU) = BTU per day (Consumption)/Recover Efficiency | 68544 | 68544 | 63974 | 59976 | 56448 |
| Time to Heat Water for Consumption Consumption Time (Hours) = Input Energy/Firing Rate | 1.7 | 1.7 | 1.6 | 1.5 | 1.4 |
| Energy Needed to Replace Standby Losses | | | | | |
| Time During Which Standby Losses Occur Standby Time (Hours) = 24 – Consumption Time | 22.3 | 22.3 | 22.4 | 22.5 | 22.6 |
| Energy in Tank When Heated to Desired Temperature Energy in Tank (BTU) = (Gallons in Tank*8.33 lb/gal*1*Tank Water Temp) | 34986 | 34986 | 34986 | 34986 | 34986 |
| Energy Needed to Replace Standby Losses Standby Energy (BTU per day) = Energy in Tank – Energy Remaining in Tank (See Table for Energy Remaining in Tank. Pick number corresponding to the hours of standby loss.) | 23754 | 19094 | 19094 | 19094 | 19094 |
| Input Energy Needed for Standby Losses Input Energy (BTU) = BTU per day (Standby Losses)/Recover Efficiency | 33934 | 27277 | 27277 | 27277 | 27277 |
| Total Daily Energy | | | | | |
| Energy for Consumption | 68544 | 68544 | 63974 | 59976 | 56448 |
| Energy for Standby | 33934 | 27277 | 27277 | 27277 | 27277 |
| Total Energy | 102478 | 95821 | 91251 | 87253 | 83725 |
| Percent Consumption | 67% | 72% | 70% | 69% | 67% |
| Percent Standby | 33% | 28% | 30% | 31% | 33% |
| Annual Costs and Benefits | | | | | |
| Natural Gas = $0.50 per therm | | | | | |
| Annual Water Heating Cost | $187 | $175 | $167 | $159 | $153 |
| Percent Savings | | 6% | 11% | 15% | 18% |
| Amount Dollar Savings | | $12 | $20 | $28 | $34 |
| Natural Gas = $0.70 per therm | | | | | |
| Annual Water Heating Cost | $262 | $245 | $233 | $223 | $214 |
| Percent Savings | | 6% | 11% | 15% | 18% |
| Annual Dollar Savings | | $17 | $29 | $39 | $48 |

TABLE 2

Benefits of Vent Damper and Heat Deflector: 40-Gallon Tank

| | Base Case | Vent Damper | Vent Damper & Heat Deflector 75% | 80% | 85% |
|---|---|---|---|---|---|
| Energy needed to Heat Water for Consumption | | | | | |
| Energy to Heat Daily Water Consumption | | | | | |
| Consumption Energy (BTU per day) = Gallons Consumed*8.33 lb/gal*1*(Tank Water Temp – Supply Water Temp) | 47981 | 47981 | 47981 | 47981 | 47981 |
| Input Energy Needed for Daily Consumption Input Energy (BTU) = BTU per day (Consumption)/Recover Efficiency | 68544 | 68544 | 63974 | 59976 | 56448 |
| Time to Heat Water for Consumption Consumption Time (Hours) = Input Energy/Firing Rate | 1.7 | 1.7 | 1.6 | 1.5 | 1.4 |
| Energy Needed to Replace Standby Losses | | | | | |
| Time During Which Standby Losses Occur Standby Time (Hours) = 24 – Consumption Time | 22.3 | 22.3 | 22.4 | 22.5 | 22.6 |
| Energy in Tank When Heated to Desired Temperature Energy in Tank (BTU) = (Gallons in Tank*8.33 lb/gal*1*Tank Water Temp) | 46648 | 46648 | 46648 | 46648 | 46648 |

TABLE 2-continued

Benefits of Vent Damper and Heat Deflector: 40-Gallon Tank

| | Base Case | Vent Damper | Vent Damper & Heat Deflector 75% | 80% | 85% |
|---|---|---|---|---|---|
| Energy Needed to Replace Standby Losses | 29610 | 23487 | 23487 | 23487 | 23487 |
| Standby Energy (BTU per day) = Energy in Tank – Energy Remaining in Tank (See Table for Energy Remaining in Tank. Pick number corresponding to the hours of standby loss.) | | | | | |
| Input Energy Needed for Standby Losses | 42301 | 33553 | 33553 | 33553 | 33553 |
| Input Energy (BTU) = BTU per day (Standby Losses)/Recover Efficiency | | | | | |
| Total Daily Energy | | | | | |
| Energy for Consumption | 68544 | 68544 | 63974 | 59976 | 56448 |
| Energy for Standby | 42301 | 33553 | 33553 | 33553 | 33553 |
| Total Energy | 110845 | 102097 | 97528 | 93529 | 90001 |
| Percent Consumption | 62% | 67% | 66% | 64% | 63% |
| Percent Standby | 38% | 33% | 34% | 36% | 37% |
| Annual Costs and Benefits | | | | | |
| Natural Gas = $0.50 per therm | | | | | |
| Annual Water Heating Cost | $202 | $186 | $178 | $171 | $164 |
| Percent Savings | | 8% | 12% | 16% | 19% |
| Amount Dollar Savings | | $16 | $24 | $32 | $38 |
| Natural Gas = $0.70 per therm | | | | | |
| Annual Water Heating Cost | $283 | $261 | $249 | $239 | $230 |
| Percent Savings | | 8% | 12% | 16% | 19% |
| Annual Dollar Savings | | $22 | $34 | $44 | $53 |

TABLE 3

Benefits of Vent Damper and Heat Deflector: 50-Gallon Tank

| | Base Case | Vent Damper | Vent Damper & Heat Deflector 75% | 80% | 85% |
|---|---|---|---|---|---|
| Energy Needed to Heat Water for Consumption | | | | | |
| Energy to Heat Daily Water Consumption | | | | | |
| Consumption Energy (BTU per day) = Gallons Consumed*8.33 lb/gal*1*(Tank Water Temp – Supply Water Temp) | 47981 | 47981 | 47981 | 47981 | 47981 |
| Input Energy Needed for Daily Consumption | 68544 | 68544 | 63974 | 59976 | 56448 |
| Input Energy (BTU) = BTU per day (Consumption)/Recover Efficiency | | | | | |
| Time to Heat Water for Consumption | 1.7 | 1.7 | 1.6 | 1.5 | 1.4 |
| Consumption Time (Hours) = Input Energy/Firing Rate | | | | | |
| Energy Needed to Replace Standby Losses | | | | | |
| Time During Which Standby Losses Occur | 22.3 | 22.3 | 22.4 | 22.5 | 22.6 |
| Standby Time (Hours) = 24 – Consumption Time | | | | | |
| Energy in Tank When Heated to Desired Temperature | 58310 | 58310 | 58310 | 58310 | 58310 |
| Energy in Tank (BTU) = (Gallons in Tank*8.33 lb/gal*1*Tank Water Temp) | | | | | |
| Energy Needed to Replace Standby Losses | 35308 | 27777 | 27777 | 27777 | 27777 |
| Standby Energy (BTU per day) = Energy in Tank – Energy Remaining in Tank (See Table for Energy Remaining in Tank. Pick number coressponding to the hours of standby loss.) | | | | | |
| Input Energy Needed for Standby Losses | 50440 | 39682 | 39682 | 39682 | 39682 |
| Input Energy (BTU) = BTU per day (Standby Losses)/Recover Efficiency | | | | | |
| Total Daily Energy | | | | | |
| Energy for Consumption | 68544 | 68544 | 63974 | 59976 | 56448 |
| Energy for Standby | 50440 | 39682 | 39682 | 39682 | 39682 |
| Total Energy | 118984 | 108226 | 103656 | 99658 | 96130 |
| Percent Consumption | 58% | 63% | 62% | 61% | 59% |
| Percent Standby | 42% | 37% | 38% | 39% | 41% |
| Annual Costs and Benefits | | | | | |
| Natural Gas = $0.50 per therm | | | | | |
| Annual Water Heating Cost | $217 | $198 | $189 | $182 | $175 |
| Percent Savings | | 9% | 13% | 16% | 19% |
| Amount Dollar Savings | | $19 | $28 | $35 | $42 |
| Natural Gas = $0.70 per therm | | | | | |

TABLE 3-continued

Benefits of Vent Damper and Heat Deflector: 50-Gallon Tank

| | Base Case | Vent Damper | Vent Damper & Heat Deflector 75% | 80% | 85% |
|---|---|---|---|---|---|
| Annual Water Heating Cost | $304 | $277 | $265 | $255 | $246 |
| Percent Savings | | 9% | 13% | 16% | 19% |
| Annual Dollar Savings | | $27 | $39 | $49 | $58 |

TABLE 4

Analysis of Vent Damper and Heat Deflector

Assumptions

| | | | |
|---|---|---|---|
| Tank Water Temp (°F.) | 140 | | |
| Supply Water Temp (°F.) | 50 | | |
| Firing Rate (BTU/Hr) | 40000 | | |
| Recovery Efficiency (%) | 70% | | |
| Daily Hot Water Volume (Gal/Day) | 64 | | |
| Tank Volume (Gallons) | 30 | 40 | 50 |
| Allowable Standby Loss (%/Hr, 2.8 + 67/V) | 5.0% | 4.5% | 4.1% |
| % Decrease in Standby Loss with Vent Damper | 30% | | |
| Standby Loss with Vent Damper (%/Hr) | 3.5% | 3.1% | 2.9% |
| % Increase in Combustion Efficiency with Heat Deflector | 7% | 11% | 21% |
| Combustion Efficiency with Heat Deflector (%) | 75% | 80% | 85% |
| Cost per Therm ($) | $0.50 | | |

Standby Loss Table

Standby Energy (BTU per Day) = Energy in Tank − (Energy in Tank*(100 − Allowable Standby Loss)*(Standby Time))

| | 30 Gallon Tank | | 40 Gallon Tank | | 50 Gallon Tank | |
|---|---|---|---|---|---|---|
| Hr. | Base Case (BTU) Energy in Tank | W/Vent Damper (BTU) Energy in Tank | Base Case (BTU) Energy in Tank | W/Vent Damper (BTU) Energy in Tank | Base Case (BTU) Energy in Tank | W/Vent Damper (BTU) Energy in Tank |
| 0 | 34986 | 34986 | 46648 | 46648 | 58310 | 58310 |
| 1 | 33225 | 33753 | 44561 | 45187 | 55896 | 56620 |
| 2 | 31553 | 32564 | 42566 | 43771 | 53582 | 54979 |
| 3 | 29965 | 31417 | 40662 | 42400 | 51364 | 53386 |
| 4 | 28456 | 30310 | 38842 | 41072 | 49237 | 51839 |
| 5 | 27024 | 29242 | 37104 | 39785 | 47199 | 50337 |
| 6 | 25664 | 28212 | 35443 | 38539 | 45245 | 48878 |
| 7 | 24372 | 27218 | 33857 | 37332 | 43372 | 47461 |
| 8 | 23145 | 26259 | 32342 | 36162 | 41576 | 46086 |
| 9 | 21980 | 25333 | 30895 | 35030 | 39855 | 44750 |
| 10 | 20874 | 24441 | 29512 | 33932 | 38205 | 43454 |
| 11 | 19823 | 23580 | 28192 | 32869 | 36623 | 42194 |
| 12 | 18826 | 22749 | 26930 | 31840 | 35107 | 40971 |
| 13 | 17878 | 21947 | 25725 | 30845 | 33653 | 39784 |
| 14 | 16978 | 21174 | 24574 | 29876 | 32260 | 38631 |
| 15 | 16124 | 20428 | 23474 | 28940 | 30925 | 37512 |
| 16 | 15312 | 19708 | 22424 | 28034 | 29644 | 36425 |
| 17 | 14541 | 19014 | 21420 | 27156 | 28417 | 35369 |
| 18 | 13809 | 18344 | 20462 | 26305 | 227241 | 34344 |
| 19 | 13114 | 17698 | 19546 | 25481 | 26113 | 33349 |
| 20 | 12454 | 17074 | 18671 | 24683 | 25032 | 32382 |
| 21 | 11827 | 16473 | 17836 | 23910 | 23995 | 31444 |
| 22 | 11232 | 15892 | 17038 | 23161 | 23002 | 30533 |
| 23 | 10667 | 15332 | 16275 | 22435 | 22050 | 29648 |
| 24 | 10130 | 14792 | 15547 | 21732 | 21137 | 28789 |

Although there has been hereinabove described specific arrangements of apparatus for the purpose of enhancing the efficiency of water heaters in illustrating the manner in which the invention can be used to advantage, it should be appreciated that the invention is not limited thereto. Accordingly, any and all modifications, variations, or equivalent arrangements which may occur to those skilled in the art, should be considered to be within the scope and spirit of the present invention as defined in the appended claims.

What is claimed is:

1. Apparatus for improving the efficiency of a water heater having a tank, a burner and a flue, said flue being disposed within said tank for evacuation of burned combustion gases therethrough with resulting heating of water in said tank, said apparatus comprising:

combustion gas directing means for enhancing heat transfer from the combustion gases through a flue wall and into surrounding water when said burner is on, said combustion gas directing means comprising a plurality of separate nestable segments; and vent damper means for preventing ambient air in the flue, heated by the directing means and flue, from escaping the flue when said burner is off.

2. The apparatus according to claim 1 wherein each of the nestable segments include protruding means for both centering the nestable segments within the flue and providing contact between the nestable segments and said flue, the nestable segments establishing an annulus between the nestable segments and the flue for the passage of combustion gas.

3. The apparatus according to claim 2 wherein each of the plurality of nestable segments is less than about 14 inches.

4. The apparatus according to claim 2 wherein each of the plurality of segments is cylindrical and each has a different diameter to enable the assembly of the elongate member with a diameter smaller at a bottom of the elongate member than at the top of the elongate member.

5. Water heater apparatus comprising:

a tank;

a burner;

flue means, disposed in said tank, for evacuation of burner combustion gases therethrough with resulting heating of water in said tank;

combustion gas directing means for enhancing heat transfer from the combustion gases through a flue wall and into surrounding water when burner is on, said combustion gas directing means comprising a plurality of separate nestable segments; and vent damper means for preventing ambient air in the flue, heated by the directing means and flue, from escaping the flue when said burner is off.

6. The apparatus according to claim 5 wherein each of the nestable segments include protruding means for both centering the nestable segments within the flue and providing contact between the nestable segments and said flue.

7. The apparatus according to claim 6 wherein each of the plurality of nestable segments is less than about 14 inches.

8. Apparatus for improving the efficiency of a gas water heater having a tank, a burner and a flue, said flue being disposed within said tank for evacuation of burner combustion gases therethrough with resulting heating of water in said tank, said apparatus comprising:

combustion gas flow controlling means, sized for disposition within said flue, for enhancing heat transfer from the combustion gases through a flue wall and into surrounding water when burner is on, said combustion gas directing means comprising a plurality of nestable segments; and vent damper means for preventing ambient air in the flue, heated by the directing means and flue, from escaping the flue when said burner is off.

9. The apparatus according to claim 8 wherein each of the nestable segments including protruding means for both centering the nestable segments within the flue and providing contact between the nestable segments and said flue, the nestable segments establishing an annulus between the nestable segments and the flue for the passage of combustion gas.

10. The apparatus according to claim 9 wherein each of the plurality of nestable segments is less than about 14 inches.

11. The apparatus according to claim 10 wherein each of the plurality of segments is cylindrical and each has a different diameter to enable the assembly of the elongate member with a diameter smaller at a bottom of the elongate member than at the top of the elongate member.

* * * * *